US005083322A

United States Patent [19]

Goodman

[11] Patent Number: 5,083,322

[45] Date of Patent: Jan. 28, 1992

[54] TOILET SYSTEM HAVING AN AIR EVACUATING SYSTEM IN A WATER STORAGE TANK

[76] Inventor: Jeff Goodman, 1351 Overlook Cove, Smyrna, Ga. 30080

[21] Appl. No.: 655,715

[22] Filed: Feb. 15, 1991

[51] Int. Cl.[5] ..... E03D 9/052

[52] U.S. Cl. ..... 4/213

[58] Field of Search ..... 4/213, 216, 347–351

[56] References Cited

U.S. PATENT DOCUMENTS

| | | | |
|---|---|---|---|
| 1,261,561 | 4/1918 | Landmann | 4/349 |
| 2,227,920 | 7/1941 | Baither | 4/213 |
| 2,277,165 | 3/1942 | Stebbing et al. | 4/213 |
| 4,251,888 | 2/1981 | Turner | 4/213 |
| 4,317,242 | 3/1982 | Stamper | 4/213 |
| 4,590,629 | 5/1986 | Lusk | 4/213 |

*Primary Examiner*—Charles E. Phillips
*Attorney, Agent, or Firm*—Terry M. Gernstein

[57] ABSTRACT

A toilet system includes a water storage tank that stores fresh water used in the flush cycle. The water storage tank is divided into two compartments by a partition wall, and an air evacuating system is located in one of the compartments, while a flush control system and flush water are located in the other compartment. The air evacuating system includes a blower connected to an air passage way located in the toilet bowl and to the waste water disposal conduit. Air from inside the toilet bowl is moved to the waste water disposal conduit.

1 Claim, 3 Drawing Sheets

TOILET SYSTEM HAVING AN AIR EVACUATING SYSTEM IN A WATER STORAGE TANK

TECHNICAL FIELD OF THE INVENTION

The present invention relates to the general art of bathroom fixtures, and to the particular field of water closets.

BACKGROUND OF THE INVENTION

Odorous air associated with toilets has long been a concern of many bathroom designers. The art contains various proposals for solving this concern.

One such proposal has included an exhaust fan located in a wall or ceiling of the room. This fan is operated by a switch to exhaust the air from the room. This is a common solution, but has several disadvantages. For example, the actual physical structure of the room must be modified to accommodate the fan assembly. This is not as much of a problem during initial construction; however, retrofitting a room may create some problems. Furthermore, these exhaust fan assemblies are not as efficient as they could be since they must move all of the air in the room to create the desired exhaust effect. This is not only inefficient, it can be wasteful of energy since some quantities of air that need not be moved are moved by such systems. These systems also tend to be somewhat noisy as well.

Therefore, there is a need for an odorous air removal system for use with a water closet that is efficient, quiet, energy-efficient and does not require alteration of the room structure to install or retrofit.

OBJECTS OF THE INVENTION

It is a main object of the present invention is to provide an odorous air removal system for use with a water closet that is efficient.

It is another object of the present invention to provide an odorous air removal system for use with a water closet that is efficient, quiet, energy-efficient.

It is another object of the present invention to provide an odorous air removal system for use with a water closet that is efficient, quiet, energy-efficient and does not require alteration of the room structure to install or retrofit.

SUMMARY OF THE INVENTION

These, and other, objects are achieved by an air evacuating system located directly within the water closet itself. Specifically, the air evacuating system includes conduits and an air mover, such as a fan or blower, located in the tank of the toilet that is presently used to store flush water. The tank is divided into two compartments by a partition wall, and the fan is located in one of those compartments. The conduits are fluidically connected directly to the toilet bowl. One of the conduits serves as an intake conduit while another serves as an exhaust conduit. The exhaust conduit is connected to a waste water disposal conduit associated with the toilet whereby maximum use is made of existing equipment. A switch controls power to the fan, and is located on the seat of the toilet. The switch is operated when the toilet seat contacts the upper rim of the toilet bowl with sufficient force to close the switch.

BRIEF DESCRIPTION OF THE DRAWING FIGURES

DETAILED DESCRIPTION OF THE PREFERRED EMBODIMENT OF THE INVENTION

Figure 1:
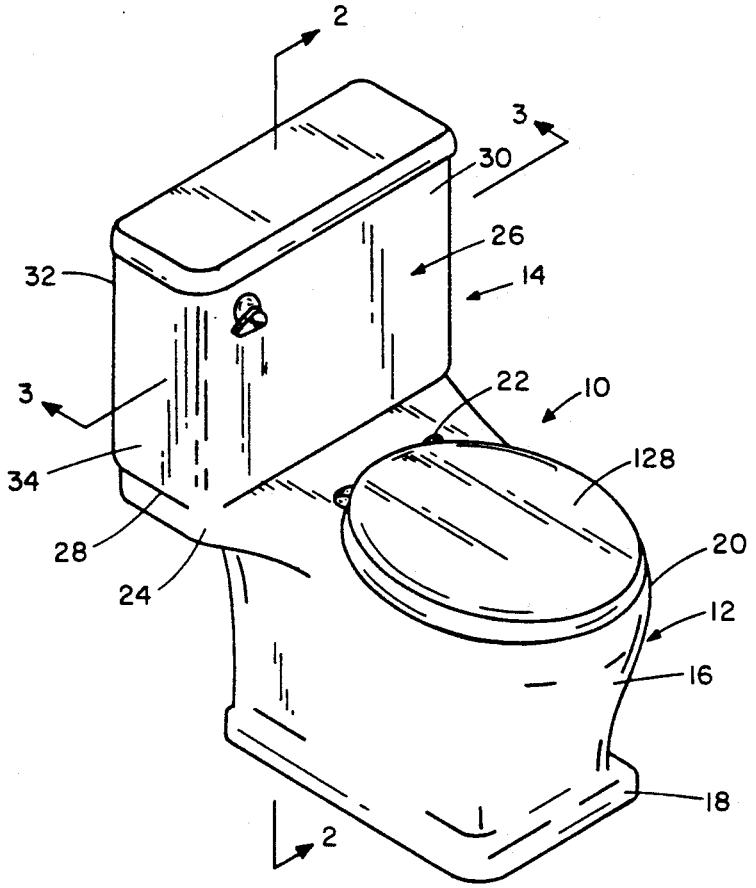
FIG. 1 is a perspective view of a water closet incorporating one form of the air evacuating system of the present invention.

Shown in FIG. 1 is a toilet system 10 that includes a bowl unit 12 mounted on a floor or the like, and a tank unit 14 mounted on the bowl unit. The toilet system 10 is connected to a fresh water source (not shown) and to a sewage and waste water disposal system (not shown) in the usual manner.

The bowl unit 12 includes a toilet bowl 16 through which water moves during a flush cycle, with the bowl having a lower base 18 connected to the support surface, and an upper rim 20. A hinge assembly 22 is mounted on the toilet bowl near an aft end thereof, and a tank mounting surface 24 forms the aft end of the toilet bowl.

The tank unit 14 is mounted on the tank mounting surface 24 and contains water that is used in the flush cycle in the manner well known to those skilled in the art. The tank unit includes a water storage tank 26 having a bottom wall 28 resting on the surface 24. A front wall 30, a rear wall 32 and end walls 34 all rest on the tank bottom wall 28. Each of the walls 30-34 has an upper rim, with all of these upper rims being coplanar. A tank top rests on top of these upper rims.

Figure 2:
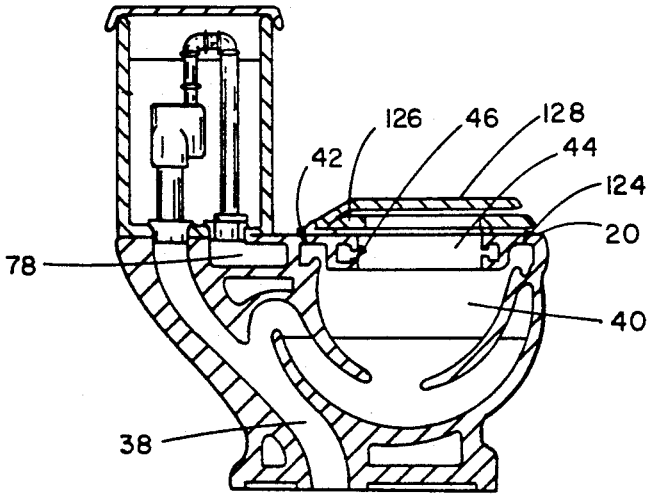
FIG. 2 is a side elevational view of the water closet taken along line 2—2 of FIG. 1.
Figure 3:
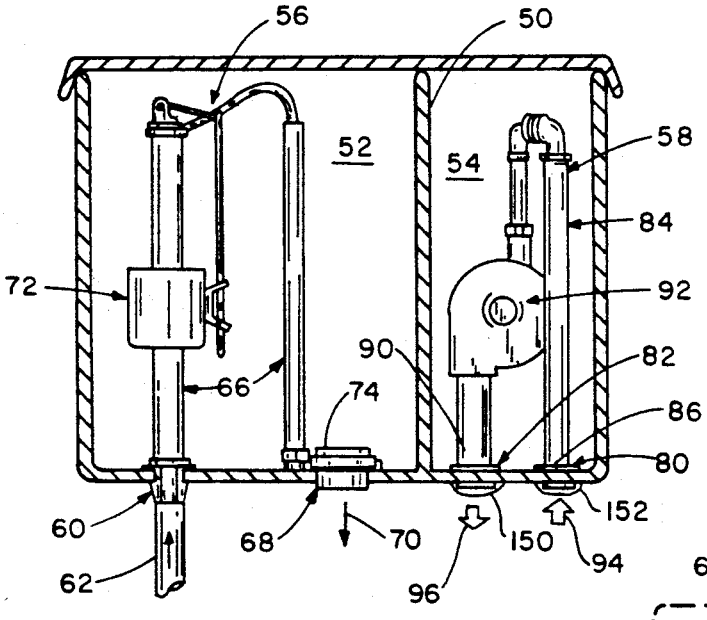
FIG. 3 is an elevational view of the water closet water tank taken along line 3—3 of FIG. 1.
Figure 4:
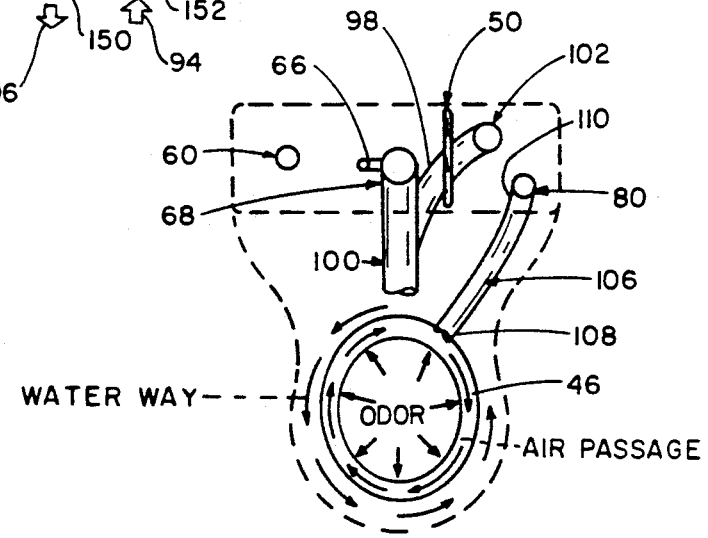
FIG. 4 is a top plan view of the water closet illustrating the location of the various elements of the air evacuating system.

Referring more specifically to FIGS. 2, 3 and 4, the toilet system 10 includes a waste water disposal conduit 38 fluidically connected to the interior volume 40 of the bowl. The bowl further includes a weir, or waterway 42 immediately circumjacent to an opening 44 defined by the rim 20. Fresh water is dispensed from the waterway into the bowl during the flush cycle. An air passage way 46 surrounds the waterway and is used to withdraw air from the toilet bowl interior volume 40. The use and operation of the air passage way 46 will be understood from the ensuing discussion..

The water storage tank 26 has an interior volume that is divided by a partition wall 50. The wall 50 extends from the bottom wall 28 to the plane containing the wall top rims, and from the front wall to the rear wall. The partition wall 50 is located between the end walls 34 to divide the tank interior volume into two chambers, first chamber 52 and second chamber 54. The first chamber 52 is larger than the second chamber 54, and contains a flush control assembly 56, while the second chamber contains an air evacuating system 58.

The flush control assembly 56 includes an inlet port 60 that is fluidically connected to the source of fresh water by a conduit 62. A conduit means 66 is fluidically connected at one end thereof to the inlet port and at another end thereof to an outlet port 68 to dispense water used in the flush cycle as indicated by arrow 70. Valve means 72 controls the opening and closing of the inlet valve during filling of the tank and valve means 74 controls the fluid outlet during the emptying of the tank. A fresh water conduit 78 fluidically connects the tank to the toilet bowl by being fluidically connected at one end thereof to the fluid outlet port 68 and at the other end thereof to the water passage way 42.

The air evacuating system 58 includes an air inlet port 80 mounted on the tank wall 28 and an air outlet port 82 mounted on the tank wall 28 adjacent to the inlet port. An air inlet duct 84 is connected at an inlet end 86 thereof to the inlet port 80 and an exhaust duct 88 is connected at an exhaust end 90 to the outlet port 82. An air moving mechanism, such as a blower 92 is inserted between the inlet duct and the outlet duct to move air through those ducts. Air from the toilet bowl enters the inlet duct 84 via inlet port 80 as indicated by arrow 94 and is exhausted via outlet port 82 as indicated by arrow 96.

An exhaust air conduit 98 is fluidically connected at an outlet end 100 thereof to the waste water disposal conduit 38 and an inlet end 102 thereof to the outlet port 82 to receive air to be exhausted and to conduct that air to the waste water disposal conduit 38. An air inlet duct 106 is connected at an inlet end 108 thereof to the air passage way 46 and at an outlet end 110 thereof to the inlet port 80 to conduct air from the toilet bowl to the air evacuating system under the influence of the blower 92.

Figure 5:
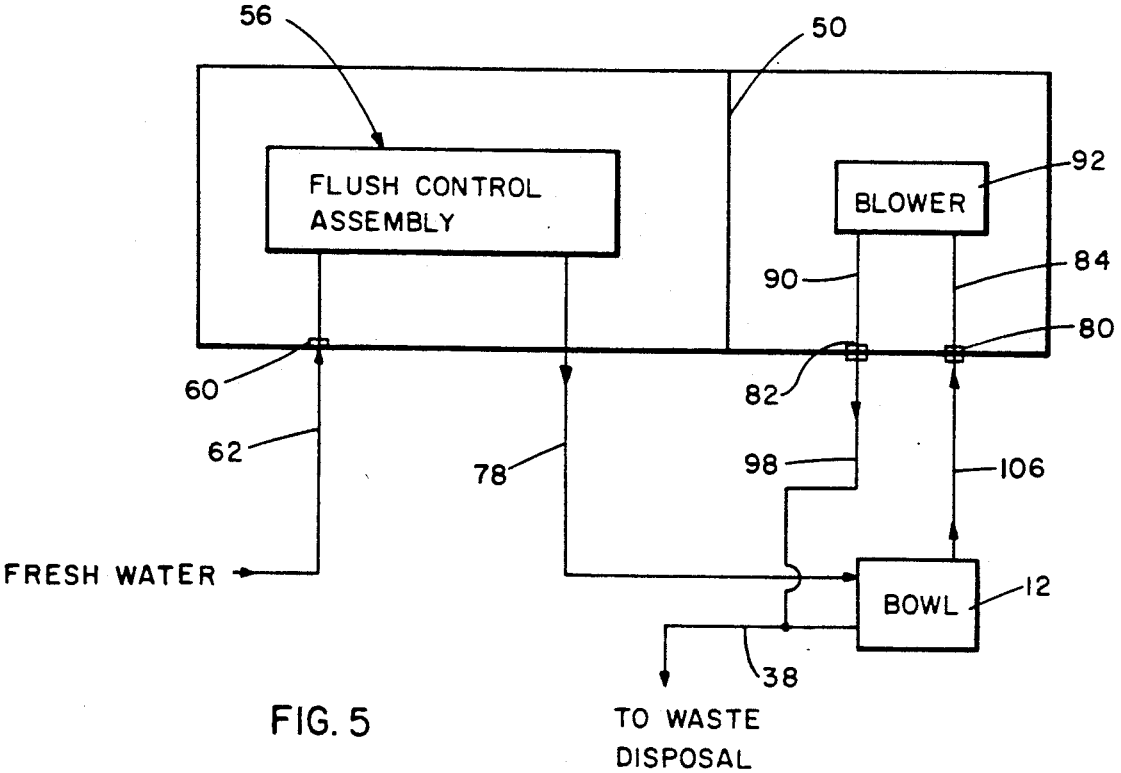
FIG. 5 illustrates the overall air evacuating system of the present invention.

The overall system is also shown in schematic form in FIG. 5 for the sake of clarity. The direction of fluid flow is indicated by the arrows in FIG. 5.

Figure 6:
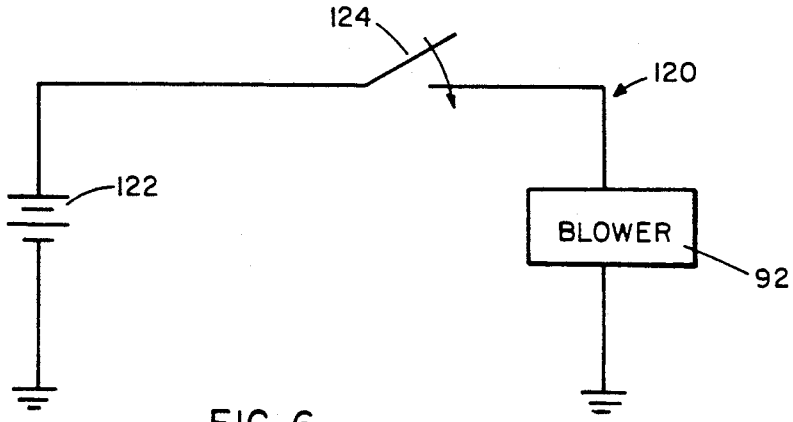
FIG. 6 is a basic circuit diagram of the electrical circuit of the air evacuating system.

The blower 92 is connected to a source of electrical power by a circuit 120 shown in FIG. 6. The circuit includes a power source 122, such as utility power or the like, and a switch 124. The switch 124 is mounted on the bottom surface of toilet seat 126 and contacts the bowl rim 20. The switch will not close under the influence of the weight of the seat and cover 128 alone, but will require a heavier weight to close. Such weight will be supplied by a person using the system sitting on the seat. Closing the switch connects the blower to the power source 122 and begins drawing air from the interior of the bowl and exhausting that air into the waste water disposal conduit 38. The fan will turn off when the user removes their weight from the seat 126.

Figure 7:
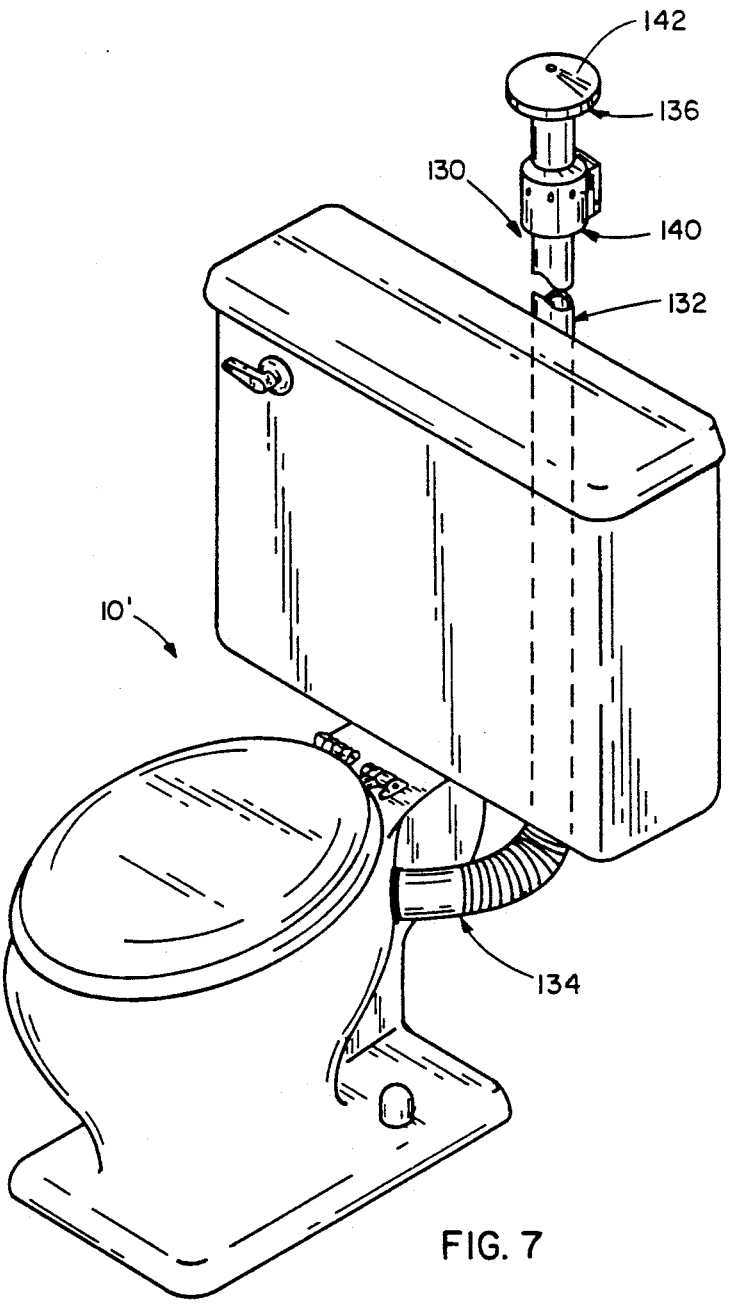
FIG. 7 is a perspective view of another form of the air evacuating system of the present invention.

An alternative form of the toilet system 10' is shown in FIG. 7. This system 10' includes an air exhaust system 130 having a connecting pipe 132 with an inlet end 134 fluidically connected to the interior of the toilet bowl, and an outlet end 136 located outside the building containing the toilet system 10'. An inline fan unit 140 is powered by the circuit 120, and draws air from the interior of the toilet and moves that air outside of the building. A rain cap 142 covers the outlet end 136.

It is also noted that semipermeable membranes 150 and 52 can be placed over the inlets to conduits 80 and 90 as shown in FIG. 3 so that water does not penetrate into the air system. The membranes are of the type that permit air to flow therethrough, but prevent the passage of moisture.

It is understood that while certain forms of the present invention have been illustrated and described herein, it is not to be limited to the specific forms or arrangements of parts described and shown.

I claim:

1. A toilet system comprising:

A) a bowl unit through which water moves during a flush cycle, said bowl unit including a seat and means for mounting said bowl unit on a support, an upper rim defining an opening into said bowl unit and hinge means, and a waterway located adjacent to said upper rim and fluidically connected to said toilet bowl;

B) a tank unit for containing water to be used during the flush cycle, said tank unit being mounted on said bowl unit and including (1) a water storage tank having a bottom, a top, a front wall, and end walls, said bottom, and end walls cooperating to form an interior volume, (2) a flush control assembly located in said tank interior volume and including (a) a fluid inlet port mounted on said bottom wall and connected to a source of fresh water, (b) a fluid outlet port mounted on said bottom wall, (c) a fluid conduit connecting said fluid inlet port to said fluid outlet port, (d) an inlet valve means controlling said fluid inlet port, (e) an outlet valve means controlling said fluid outlet port, (f) a fresh water conduit fluidically connecting said outlet port to said toilet bowl, (g) a waste water disposal conduit fluidically connecting said toilet bowl to a waste water disposal system, and (h) a water passage way mounted on said toilet bowl rim, said fresh water conduit having an outlet that is fluidically connected to said water passage way to receive water from said water storage tank and having an outlet located inside said toilet bowl for dispensing water received from said storage tank into said toilet bowl, (3) a partition wall in said water storage tank interior volume, said partition wall being located between said storage tank end walls, and being connected to said storage tank bottom wall and to said storage tank front wall and to said storage tank rear wall to divide said storage tank interior volume into a first compartment and a second compartment, with said first compartment being larger than said second compartment and being fluidically sealed from said second compartment, said flush control assembly being located in said first compartment, and (4) an air evacuating system including (a) an air passage way mounted on said toilet bowl immediately adjacent to said bowl unit opening through said upper rim and between said bowl unit opening and said water passage way adjacent to said water passage way, said air passage way having an inlet and an outlet, with said air passage way inlet being fluidically connected to said toilet bowl, (b) an air inlet port mounted on said storage tank bottom in said second chamber, (c) an air exhaust port mounted on said storage tank bottom in said second chamber, (d) a first exhaust air conduit having an inlet end fluidically connected to said air passage way outlet and an outlet end fluidically connected to said air evacuating system air inlet port, (e) a second exhaust air conduit having an inlet end fluidically connected to said air evacuating system air exhaust port and an outlet fluidically connected to said waste water disposal conduit, (f) a first fluid duct having an inlet and fluidically connected to said air evacuating system inlet port, (g) a second fluid duct having an outlet end fluidically connected to said air evacuating system outlet port, (h) a blower unit located in said second chamber, said first fluid duct having an outlet end fluidically connected to said blower unit, and said second fluid duct having an inlet and fluidically connected to said blower unit, (i) a first semipermeable membrane covering said air evacuating system inlet port, and (j) a second semipermeable membrane covering said air evacuating system exhaust port; and (C) a power circuit connecting said blower to a source of electrical power, and including a switch mounted on said bowl seat.

* * * * *